US007136940B2

(12) United States Patent
Roh et al.

(10) Patent No.: US 7,136,940 B2
(45) Date of Patent: Nov. 14, 2006

(54) INTERNET REFRIGERATOR WITH WEB PAD AND METHOD FOR OPERATING THE SAME

(75) Inventors: Young Hoon Roh, Seoul (KR); Jung Ho Kim, Seoul (KR); Jin Cheol Cho, Seoul (KR); Jae Won Chang, Seoul (KR); Sang Hyuk Kang, Pusan (KR); Sang Mahn Kim, Kyunggi-do (KR); Pan Su Kim, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 279 days.

(21) Appl. No.: 10/701,614

(22) Filed: Nov. 6, 2003

(65) Prior Publication Data

US 2004/0093379 A1 May 13, 2004

(30) Foreign Application Priority Data

Nov. 8, 2002 (KR) ..... 10-2002-0069194

(51) Int. Cl.

| | |
|---|---|
| ***G06F 3/01*** | (2006.01) |
| ***G06F 13/10*** | (2006.01) |
| ***G09G 5/00*** | (2006.01) |
| *G06F 3/00* | (2006.01) |

(52) U.S. Cl. ..... 710/8; 710/15; 345/169

(58) Field of Classification Search ..... 710/8, 710/15; 345/169, 173

See application file for complete search history.

(56) References Cited

U.S. PATENT DOCUMENTS

| | | | | |
|---|---|---|---|---|
| 2001/0010516 | A1* | 8/2001 | Roh et al. | 345/169 |
| 2001/0021998 | A1* | 9/2001 | Margulis | 725/81 |
| 2002/0157411 | A1* | 10/2002 | Ishikawa et al. | 62/231 |

FOREIGN PATENT DOCUMENTS

| | | | |
|---|---|---|---|
| GB | 2394032 | | 4/2004 |
| JP | 2001324258 | A * | 11/2001 |

* cited by examiner

*Primary Examiner*—Fritz Fleming
*Assistant Examiner*—Scott Sun
(74) *Attorney, Agent, or Firm*—Greenblum & Bernstein, P.L.C.

(57) ABSTRACT

An Internet refrigerator with a Web pad and a method for operating the same. The Web pad is detachably mounted on the Internet refrigerator, and transmits and receives data to/from the Internet refrigerator on the basis of a remote display protocol (RDP). The Web pad is a client Web pad detachably mounted on an outer surface of the Internet refrigerator. The client Web pad is adapted to receive a display signal transmitted from the Internet refrigerator and output the received display signal externally. A server control unit is provided to transmit the display signal to the client Web pad on the basis of the remote display protocol such that data processed in the Internet refrigerator is displayed through the client Web pad. Application programs and multimedia data are driven on the basis of the server control unit, resulting in a reduction in work-load on the client Web pad.

10 Claims, 5 Drawing Sheets

INTERNET REFRIGERATOR WITH WEB PAD AND METHOD FOR OPERATING THE SAME

RELATED APPLICATIONS

The present disclosure relates to subject matter contained in Korean Application No. 2002-0069194, filed on Nov. 8, 2002, which is expressly incorporated herein by reference in its entirety.

BACKGROUND OF THE INVENTION

1. Field of the Invention

The present invention relates to an Internet refrigerator with a Web pad and a method for operating the same. More particularly, the present invention relates to an Internet refrigerator with a Web pad and a method for operating the same, wherein the Web pad is a client Web pad which is detachably mounted on the Internet refrigerator and connected thereto in a wired/wireless manner. Further, according to the present invention, a server control unit is provided in the Internet refrigerator to drive an application program and multimedia resources for rapid transmission and reception of signals between the Internet refrigerator and the client Web pad and to output a display signal based on a remote display protocol to the client Web pad to display the multimedia resources through the Web pad.

2. Description of the Related Art

A conventional Internet refrigerator will hereinafter be described with reference to FIG. 1 which shows the outer appearance thereof.

Generally, refrigerators are home appliances that have inner compartments for storage of food and in which a refrigerant circulates while being maintained at a low temperature to preserve the food from spoilage or decay so as to keep it in a fresh state or condition for a long time.

Recently, a refrigerator has been developed which has a display unit, a key input unit, a processor for signal processing, and etc. to perform a general computer function in a kitchen, in addition to the above-mentioned basic refrigeration function. In particular, this refrigerator additionally has a capability of obtaining access to an external Internet network. As a result, a user can not only upload/download data to/from a Web page connected to the Internet network, but can also search the connected Web page for desired data. Such a refrigerator with the Internet access function is typically called an Internet refrigerator, which is denoted by the reference character R in FIG. 1.

In the case where a home network is provided in a building and a plurality of home appliances are connected to the home network, the Internet refrigerator R can be used as a home server for centrally controlling the plurality of home appliances. The reason for using the Internet refrigerator as the home server is that the Internet refrigerator R is generally always in its driven state (i.e., in an in ON condition), so that it is capable of monitoring, in real time, variations in states of the home appliances connected to the home network.

To this end, the Internet refrigerator R includes, as shown in FIG. 1, an input/display unit 1, such as a touch pad, mounted on its outer surface. The user can readily monitor Internet data or home appliance state data displayed through the display unit 1.

In order to replace the existing display unit 1 of the Internet refrigerator R, there has recently been proposed a portable device such as a Web pad equipped with a wireless communication module based on a wireless local area network (LAN) protocol, which is a wireless communication protocol developed to enable wireless communication within a predetermined distance. The Web pad is detachably mounted on the Internet refrigerator R to replace the display unit 1.

In other words, the Web pad, detachably mounted on the Internet refrigerator R, is utilized as the display unit 1 of the refrigerator R when it is mounted on the refrigerator R, and wirelessly transmits and receives data to/from the refrigerator R when detached from the refrigerator R. As a result, the Web pad receives a control command input by a remote user within a predetermined distance and displays a controlled result based on the control command.

The Web pad is adapted to process a control command wirelessly transmitted in its detached state and output a display signal to display a controlled result based on the control command. To this end, the Web pad has a microcomputer for independently processing data transmitted and received to/from the refrigerator.

For example, when the user intends to execute an application program 'A' stored in the Internet refrigerator by operating the Web pad, the Web pad drives (i.e., runs or executes) the application program 'A' stored therein because the same application programs 'A' are stored in both the refrigerator and in the Web pad. This application program 'A' may be, for example, a housekeeping log, telephone directory or refrigerator manager, although it is not limited to these examples.

The user can create, edit and delete data by operating the application program driven or running in the Web pad when the driven state of the application program is displayed through the Web pad. The Web pad transmits data changed by the operation of the application program to the Internet refrigerator, which then updates data stored therein with the transmitted data.

To this end, the Web pad must further have a proper level of hardware to manage resources for the driving of the application program and to process the data.

A server control unit 2 is typically mounted on the top surface of the Internet refrigerator R in the form of a chip set to perform a home server function of the refrigerator R and to process data at a high speed. When the Web pad is detached from the Internet refrigerator R, the server control unit 2 manages data wirelessly transmitted and received to/from the Web pad, and wirelessly receives new data created or generated by the operation of the Web pad and updates the existing data with the newly received data.

Accordingly, a work-load for the application program driving and data processing is mostly applied to the Web pad, thereby causing congestion in signal traffic between the Web pad and the Internet refrigerator R and making it impossible to rapidly conduct the command input and processing using the Web pad. In particular, provided that an application program that requires a considerable amount of resources to run and a large amount of data are transmitted and received, the signal traffic will suffer severe congestion, resulting in data damage or loss and, thus, instability.

Furthermore, because duplicates of the same application programs are installed in the Web pad and in the Internet refrigerator, a considerable amount of time and cost are required in installing, maintaining and updating the application programs, which causes inconvenience to the user.

SUMMARY OF THE INVENTION

Therefore, the present invention has been made in view of the above problems, and it is an object of the present invention to provide an Internet refrigerator with a Web pad and a method for operating the same, wherein the Web pad is a client Web pad which is detachably mounted on the Internet refrigerator and connected thereto in a wired/wireless manner. The web pad transmits and receives signals to/from the refrigerator according to a remote display protocol, and most resources are run in the Internet refrigerator and displayed through the client Web pad, so that a workload on the client Web pad can be significantly reduced to enable a more rapid remote control.

In accordance with one aspect of the present invention, the above and other objects can be accomplished by the provision of an Internet refrigerator with a Web pad with the Web pad being a client Web pad detachably mounted on an outer surface of the Internet refrigerator. The client Web pad receives a display signal transmitted from the Internet refrigerator and outputs the received display signal externally. A server control unit is provided for transmitting the display signal to the client Web pad on the basis of a remote display protocol such that data processed in the Internet refrigerator is displayed through the client Web pad.

In accordance with another aspect of the present invention, there is provided a method for operating an Internet refrigerator with a Web pad. The method comprises detachably mounting the Web pad on an outer surface of the Internet refrigerator and inputting a control command through the Web pad, with the Web pad being a client Web pad, driving resources of the Internet refrigerator in response to the input control command, transmitting a display signal based on a remote display protocol to the client Web pad so that a driven state of the resource of the refrigerator can be displayed through the client Web pad and displaying data received by the client Web pad in response to the transmitted display signal.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
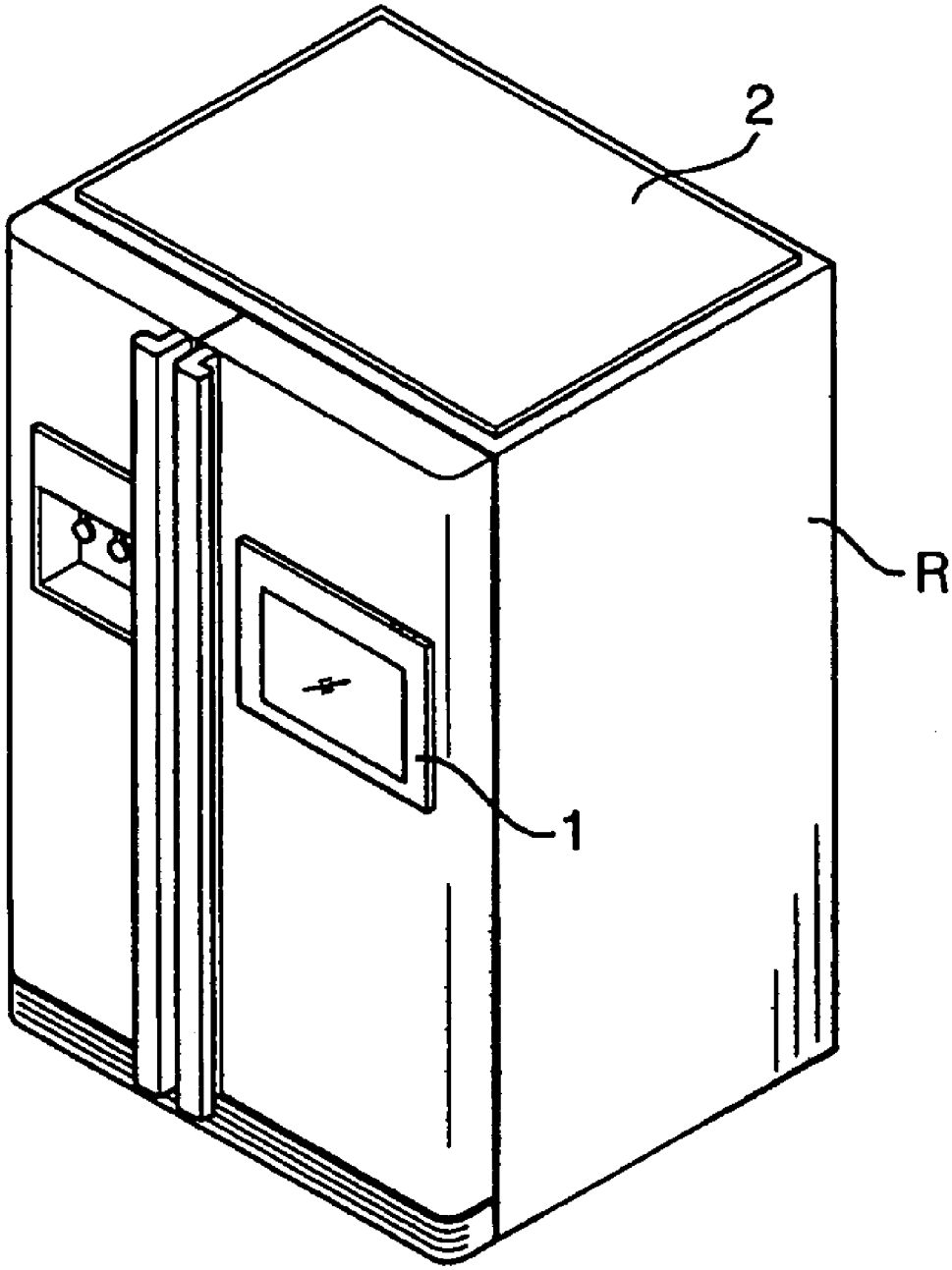
Fig. 1(Prior Art)
FIG. 1 is a perspective view showing the outer or exterior appearance of a conventional Internet refrigerator.
Figure 2:
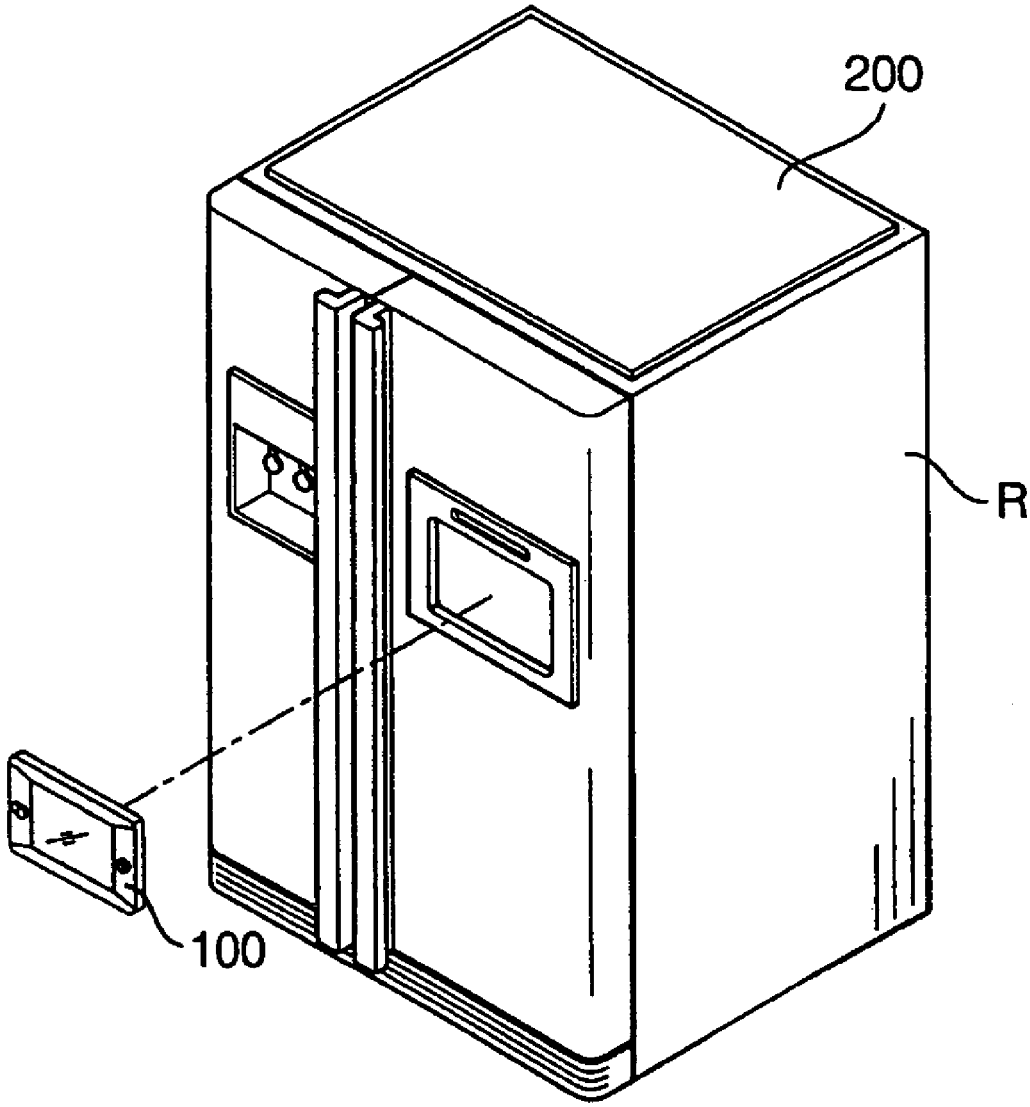
FIG. 2 is a perspective view showing the outer or exterior appearance of an Internet refrigerator with a Web pad in accordance with the present invention.
Figure 3:
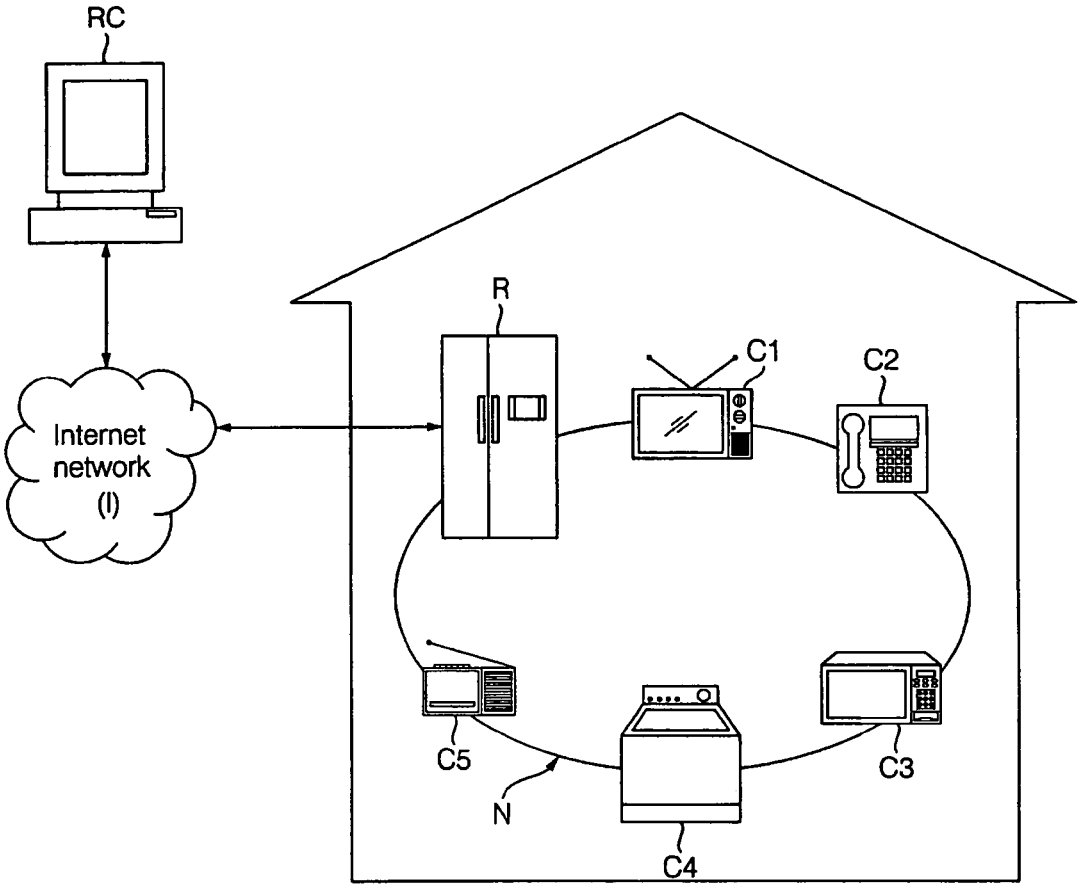
FIG. 3 is a view schematically showing the overall system of the Internet refrigerator with the Web pad in accordance with the present invention.

FIG. 2 is a perspective view showing the outer appearance of an Internet refrigerator with a Web pad in accordance with the present invention and FIG. 3 is a view schematically showing the overall system of the Internet refrigerator with the Web pad in accordance with the present invention. A detailed description will hereinafter be given of the construction of the Internet refrigerator with the Web pad in accordance with the present invention with reference to FIGS. 2 and 3.

The Web pad, denoted by the reference numeral 100, is detachably mounted on the outer surface of the Internet refrigerator, denoted by the reference character R, preferably on the outer surface of a door of the refrigerator R, as shown in FIG. 2. Since the Internet refrigerator R is usable as a home server and the Web pad 100 is affiliated to the refrigerator R as a client device, the Web pad 100 will be specifiedly referred to hereinafter as a "client Web pad".

The client Web pad 100 can preferably, for example, be a personal digital assistant (PDA) for receiving a user's command input in a touch screen manner on a liquid crystal screen of a predetermined size and performing a variety of functions, such as E-mail transmission/reception, word processing, an electronic book, etc., which is typically called a tablet personal computer (PC). The client Web pad 100 is equipped with a wireless LAN module so that it can be wirelessly networked with peripheral devices within a maximum range of e.g., about 100 meters. Of course, the client web pad 100 can be embodied in devices other than a PDA, as long as they can perform the required functions.

The client Web pad 100, detachably mounted on the Internet refrigerator R, receives a refrigerator associated command, a home networking command, an Internet command and so forth input by the user, transmits the received commands to a server control unit 200 of the refrigerator R, receives processed results based on those commands from the server control unit 200 and displays the receives results so that the user can readily monitor the processed results. During this time, the transmission and reception between the client Web pad 100 and the server control unit 200 are carried out in a wired/wireless (i.e., wired and/or wireless) manner.

Where the Internet refrigerator R is connected to a home network N constructed in a home to function as a home server, the server control unit 200 controls the monitoring of the states or conditions of a plurality of home appliances C1 to C5 connected to the home network N and the signal flow thereamong (FIG. 3).

The Internet refrigerator R is also adapted and configured to relay data of the home network N to an external Internet network I, because it is connectable with the Internet network I. That is, if the user desires to remotely control the plurality of home appliances C1–C5, he/she can access the Internet refrigerator R with the home server function through a remote control device RC (such as, for example, an Internet browser-enabled PC) connectable with the Internet network I and can thus control the home appliances C1–C5 connected to the home network N.

The Internet refrigerator R of the present invention is preferably connected to an antenna terminal of a media medium, such as a television set C1 or audio (i.e., radio) set C5, through a terminal formed at its outer wall. Therefore, the Internet refrigerator R can receive video data from the television set C1 or audio data from the audio set C5, which data is typically called multimedia data.

Figure 4:
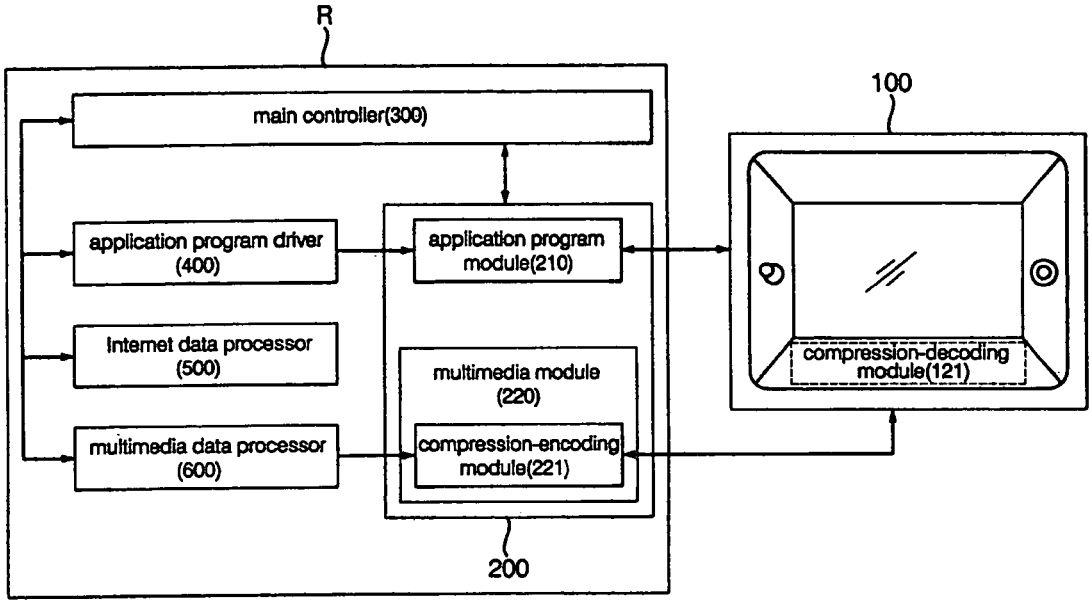
FIG. 4 is a functional block diagram showing the configuration of the Internet refrigerator with the Web pad in accordance with the present invention.

The construction of the Internet refrigerator with the Web pad in accordance with the present invention will hereinafter be described in more detail with reference to FIG. 4.

The client Web pad 100 and the server control unit 200 of the Internet refrigerator R preferably transmit and receive signals therebetween on the basis of a remote display protocol (RDP). The remote display protocol is a presentation protocol that enables a client device to exchange information with a server device over a network. The server device drives an application program in response to a command remotely input by the client device, and the client device displays the driven state of the application program provided from the server device.

Data or multimedia data based on an application program driven or running in the Internet refrigerator R is transmitted to the client Web pad 100 through a protocol stack on the basis of the remote display protocol. The server control unit 200 of the Internet refrigerator R with the home server function executes the application program by performing a series of tasks.

The client device, or the client Web pad 100, receives the data created or generated by the application program driven in the Internet refrigerator R and displays the received data, which is typically called a server-based computing operation. The remote display protocol is a protocol for enabling this server-based computing operation.

Accordingly, a plurality of client devices can be connected to a server device, such as the Internet refrigerator R, to independently execute different application programs, and the server device can process work-loads for the program executions. As a result, the client devices can perform only display operations with no need to include the hardware required to drive the application programs.

The Internet refrigerator R with the Web pad according to the present invention can perform the server-based computing operation by transmitting and receiving signals on the basis of the remote display protocol (RDP).

In the Internet refrigerator R, a main controller 300 is adapted to perform basic refrigeration associated functions. That is, in response to refrigeration associated commands input by the user, the main controller 300 maintains an internal temperature of the refrigerator and monitors the state of food stored in the refrigerator. The main controller 300 also displays operated results externally. In addition, the main controller 300 controls the flow of all signals processed in the Internet refrigerator R.

An application program driver 400 is provided to drive a variety of application programs installed in the Internet refrigerator R. The application programs may be, for example, a user program, such as a housekeeping log, telephone directory or memo pad, a refrigerator control program, and an access program for Internet access or multimedia data reception.

An Internet data processor 500 is also provided to receive Internet data from a Web page connected through the external Internet network and process the received Internet data so that the processed result can be displayed through the client Web pad 100. If the user inputs a control command to remotely control any of home appliance in the home through the Internet network, then the input control command is transferred to the server control unit 200 via the Internet data processor 500.

A multimedia data processor 600 is also provided to receive multimedia data from an antenna terminal of a media medium connected with the Internet refrigerator R, such as a television set or a radio set, and transfer the received multimedia data to a multimedia module 220 to be described below, so that the received multimedia data can be displayed through the client Web pad 100.

The server control unit 200 is adapted to perform the home server function of controlling signals transmitted and received to/from the plurality of home appliances connected to the home network. Preferably, the server control unit 200 transmits a display signal, based on the remote display protocol, to the client Web pad such that the data created/processed by the application program driver 400, Internet data processor 500 and multimedia data processor 600 is displayed through the client Web pad 100.

The server control unit 200 basically includes an application program module 210 and the multimedia module 220. The application program module 210 acts to control the application program driver 400 in response to an execution command input from the client Web pad 100 to drive one of the application programs corresponding to the input execution command. The application program module 210 also acts to transmit a display signal to the client Web pad 100 so that the driven state of the corresponding application program can be displayed through the client Web pad 100.

The multimedia module 220 acts to transmit a display signal to the client Web pad 100 so that the data processed by the multimedia data processor 600 can be displayed through the client Web pad 100.

The multimedia module 220 preferably includes a compression-encoding module 221 for compressing the multimedia data processed by the multimedia data processor 600. The compression-encoding module 221 enables large-capacity multimedia data containing video and audio information to be rapidly transmitted to the client Web pad 100.

In this connection, the client Web pad 100 preferably includes a compression-decoding module 121 for decoding the compressed multimedia data transmitted from the Internet refrigerator R.

The client Web pad 100 is adapted and configured to receive and display data transmitted from the server control unit 200. Towards this end, the client Web pad 100 is connected with the Internet refrigerator R in a wired manner based on contacting terminals when it is mounted on the refrigerator R. Alternatively, when the client Web pad 100 is detached from the Internet refrigerator R be in a portable state, it is connected with the refrigerator R in a wireless manner based on a wireless communication protocol.

For example, the client Web pad 100 may receive a display signal of multimedia data transmitted in real time from the Internet refrigerator R and display the multimedia data externally (i.e., on an external surface of the client web pad 100). At this time, if a picture of a specific application program is being displayed, it is automatically hidden. When the display of the multimedia data is completed, the specific application program picture is automatically released from its hidden state and is displayed again.

Figure 5:
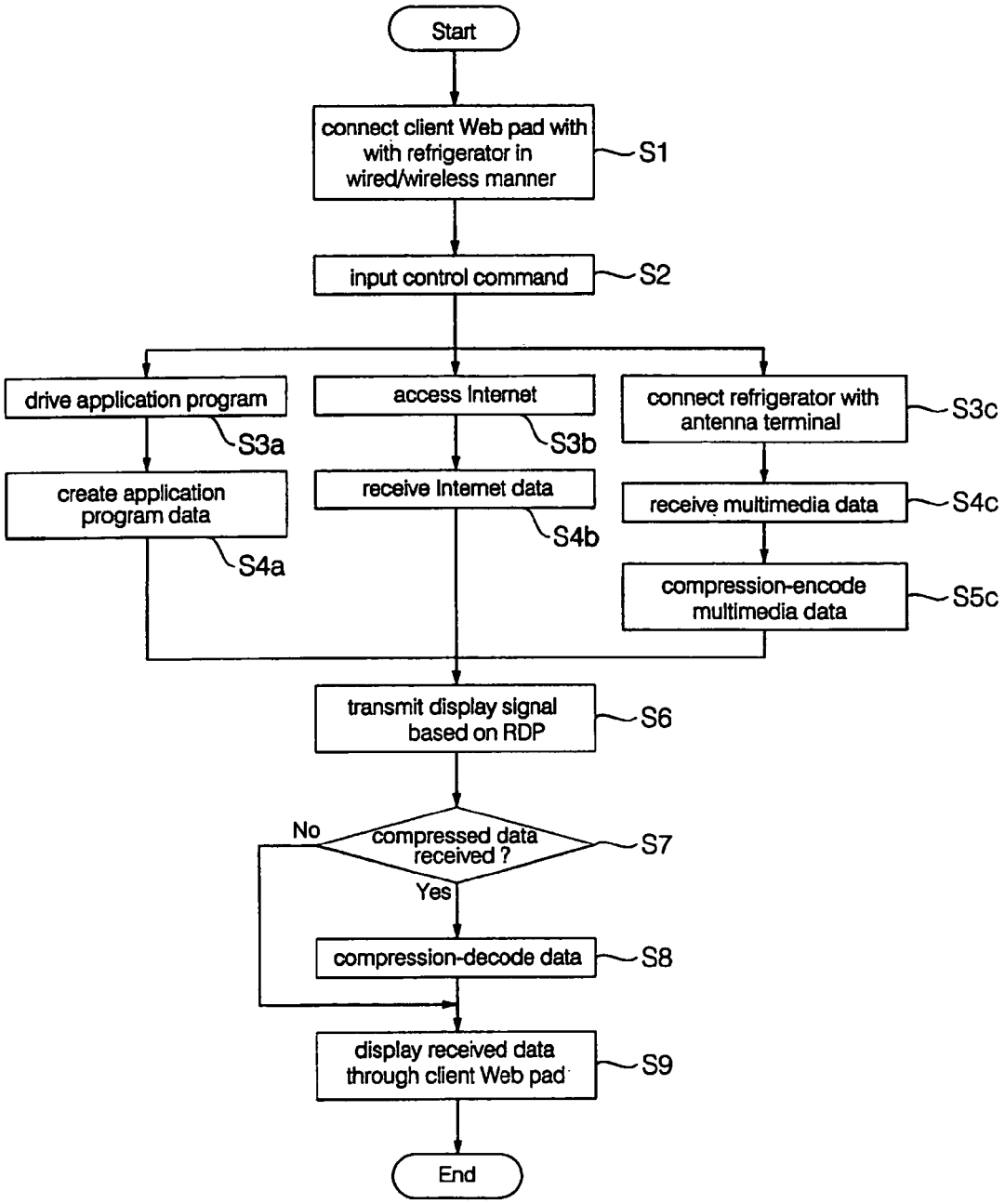
FIG. 5 is a flow chart illustrating the operation of the Internet refrigerator with the Web pad in accordance with the present invention.

Next, a description will be given of the operation of the Internet refrigerator with the above-stated construction in accordance with the present invention with reference to FIG. 5.

First, the client Web pad is detachably mounted on the Internet refrigerator and then connected with the refrigerator in a wired or wireless manner (S1).

Then, the user inputs a control command by operating the client Web pad, and the input control command is transmitted to the Internet refrigerator through the client Web pad (S2).

The control command may be, for example, an execution command for execution of an application program installed in the Internet refrigerator, an access command for access to the external Internet network via the Internet refrigerator, or a multimedia data reception command for reception of multimedia data from a media medium connected with the Internet refrigerator, such as a television set or a radio.

The Internet refrigerator drives the resources thereof in response to the control command. Namely, when the control command is the application program execution command, the Internet refrigerator drives an application program corresponding to the execution command (S3*a*) and creates or generates application program data in response to an operation of the corresponding application program by the user (S4*a*).

When the control command is the Internet access command, the Internet refrigerator is connected with the external Internet network (S3*b*) to receive a Web page, a file, and etc. over the Internet network (S4*b*).

When the control command is the multimedia data reception command, the refrigerator receives multimedia data of video and or audio information from an antenna terminal of the media medium (S4*c*) in real time when it is connected with the antenna terminal of the media medium (S3*c*). Then, the received multimedia data is compression-encoded to increase the transfer rate thereof (S5*c*).

Thereafter, the Internet refrigerator transmits a display signal based on the remote display protocol to the client Web pad such that the data processed in the above manner is displayed through the client Web pad (S6).

Upon receiving the display signal transmitted from the Internet refrigerator, the client Web pad determines whether the processed data is in its compressed state (S7). If the processed data is determined to be in its compressed state, then the client Web pad decodes the processed data so that it can have a recognizable data format (S8).

Lastly, the client Web pad displays the application program data, Internet data or multimedia data transmitted from the Internet refrigerator (S9).

As apparent from the above description, the present invention provides an Internet refrigerator with a Web pad and a method for operating the same, wherein the Web pad is a client Web pad which is detachably mounted on the Internet refrigerator, and software driving resources are driven in a high-level server control unit and displayed through the client Web pad according to a remote display protocol. Therefore, the resources can be efficiently managed to prevent congestion in signal traffic resulting from a heavy work-load on the client Web pad. Further, it is not necessary to upgrade the hardware or software of the client Web pad, resulting in a reduction in cost.

While the present invention has been described with regard to an embodiment utilizing an Internet refrigerator, the present invention can also be an embodiment in any other home appliance, in particular any of the appliances attached to the home network N shown in FIG. 3. Further, while a "side by side" type refrigerator is shown, the present invention is not limited thereto and is applicable to all types of refrigerators and/or freezers.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An Internet refrigerator, comprising:

a server controller that transmits a display signal to a client Web pad on the basis of a remote display protocol such that data processed in said Internet refrigerator is displayed through said client Web pad;

a main controller that performs refrigeration associated functions;

an application program driver that drives a plurality of application programs installed in said Internet refrigerator; and an Internet data processor that processes data transmitted and received over an external Internet network, wherein said client Web pad is detachably mounted on an outer surface of said Internet refrigerator, receives a first display signal and a second display signal transmitted from said Internet refrigerator and displays the received display signals;

wherein said server controller includes an application program module that outputs a control signal to said application program driver in response to an execution command input from said client Web pad to drive one of said application programs corresponding to the input execution command, and transmits said first display signal to said client Web pad so that the corresponding application program can be displayed through said client Web pad;

wherein said server controller includes a multimedia module that transmits said second display signal to said client Web pad so that multimedia data transmitted from at least one of a television and a radio can be displayed through said client Web pad, and wherein said server controller is configured to perform a home server function of transmitting and receiving signals to and from a plurality of home appliances connected to a home network.

2. The Internet refrigerator as set forth in claim 1, wherein said multimedia module includes a compression-encoding module that compresses said multimedia data processed by a multimedia data processor.

3. The Internet refrigerator as set forth in claim 1, wherein said Internet refrigerator includes a terminal configured for communications with an antenna terminal of at least one of a television and a radio; and wherein said Internet refrigerator further comprising a multimedia data processor that processes multimedia data transmitted in real time from the antenna terminal.

4. The Internet refrigerator as set forth in claim 1, wherein said client Web pad includes a compression-decoding module that decodes compressed multimedia data transmitted from said Internet refrigerator.

5. A method for operating a client Web pad with an Internet refrigerator including a server, comprising:

detachably mounting the client Web pad on an outer surface of said Internet refrigerator and inputting a control command through the Client Web pad;

driving resources of said Internet refrigerator in response to the input control command;

transmitting, to the client Web pad, a first display signal, based on a remote display protocol, for an application program so that the application program can be displayed through said client Web pad, and transmitting, to the client Web pad, a second display signal, based on a remote display protocol, for multimedia data, so that the multimedia data can be displayed through said client Web pad, such that a driven state of the resources of the refrigerator is displayed through the client Web pad;

displaying the application program, in response to the first display signal being received by the client Web pad, and displaying the multimedia data, in response to the second display signal being received by the client Web pad, and performing, at a server controller of the Internet refrigerator, a home server function of transmitting and receiving signals to and from a plurality of home appliances connected to a home network.

6. The method as set forth in claim 5, wherein driving the resources comprises:

connecting said Internet refrigerator with an antenna terminal of a media when the input control is a media connection request command;

receiving multimedia data transmitted from the antenna terminal; and compression-encoding the received multimedia data.

7. The method as set forth in claim 6, wherein the displaying comprises decoding the data received by the client Web pad when the data is in a compressed state.

8. A method for operating an Internet refrigerator with a client Web pad, comprising:

detachably mounting the client Web pad on an outer surface of said Internet refrigerator and inputting a control command through the client Web pad;

driving resources of said Internet refrigerator in response to the input control command;

transmitting a first display signal for an application program and a second display signal for multimedia data to the client Web pad such that a driven state of the resources of the refrigerator is displayed through the client Web pad, at least one of the first display signal and the second display signal being based on a remote display protocol;

displaying data received by the client Web pad in response to the transmitted display signal, and performing, at a server controller of the Internet refrigerator, a home server function of transmitting and receiving signals to and from a plurality of home appliances connected to a home network.

9. The method as set forth in claim 8, wherein driving the resources comprises:

connecting said Internet refrigerator with an antenna terminal of a media when the input control is a media connection request command;

receiving multimedia data transmitted from the antenna terminal; and compression-encoding the received multimedia data.

10. The method as set forth in claim 9, wherein the displaying comprises decoding the data received by the client Web pad if the data is in a compressed state.

* * * * *